US010550641B2

(12) United States Patent
Tsang

(10) Patent No.: US 10,550,641 B2
(45) Date of Patent: Feb. 4, 2020

(54) HAMMER DRILL MECHANISM

(71) Applicant: Halliburton Energy Services, Inc., Houston, TX (US)

(72) Inventor: John Siu Lun Tsang, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/541,896

(22) PCT Filed: Feb. 6, 2015

(86) PCT No.: PCT/US2015/014744
§ 371 (c)(1),
(2) Date: Jul. 6, 2017

(87) PCT Pub. No.: WO2016/126258
PCT Pub. Date: Aug. 11, 2016

(65) Prior Publication Data
US 2017/0356248 A1 Dec. 14, 2017

(51) Int. Cl.
*E21B 4/10* (2006.01)
*E21B 6/02* (2006.01)
*E02F 5/20* (2006.01)

(52) U.S. Cl.
CPC ..... *E21B 4/10* (2013.01); *E21B 6/02* (2013.01); *E02F 5/20* (2013.01)

(58) Field of Classification Search
CPC ..... E21B 4/10; E21B 6/02; E02F 5/20
See application file for complete search history.

(56) References Cited

U.S. PATENT DOCUMENTS

| | | | | |
|---|---|---|---|---|
| 3,396,807 | A * | 8/1968 | Menton | E21B 4/10 175/293 |
| 6,386,301 | B1 | 5/2002 | Rear | |
| 6,557,653 | B2 | 5/2003 | Hauptmann et al. | |
| 6,659,202 | B2 | 12/2003 | Runquist et al. | |
| 6,761,231 | B1 | 7/2004 | Dock et al. | |
| 7,191,848 | B2 | 3/2007 | Ha | |
| 8,720,608 | B2 | 5/2014 | Downton et al. | |
| 8,739,901 | B2 | 6/2014 | Cote | |
| 2002/0084109 | A1 | 7/2002 | Runquist et al. | |
| 2004/0140131 | A1 | 7/2004 | Susman | |
| 2012/0118648 | A1 | 5/2012 | Lorger | |
| 2013/0051177 | A1* | 2/2013 | Vecseri | E21B 47/18 367/82 |
| 2013/0264119 | A1 | 10/2013 | Gynz-Rekowski et al. | |

(Continued)

OTHER PUBLICATIONS

International Search Report and Written Opinion issued in corresponding application No. PCT/US2015/014744 dated Oct. 28, 2015, 13 pgs.

*Primary Examiner* — Giovanna C Wright
*Assistant Examiner* — Yanick A Akaragwe
(74) *Attorney, Agent, or Firm* — Chamberlain Hrdlicka

(57) ABSTRACT

Various embodiments include methods and apparatus structured to increase efficiencies of a drilling operation. A drilling apparatus can be structured to include a hammer drill to move a hammer to impart impact force to a bit box in conjunction with a rotary drive shaft. The hammer drill can be arranged as a mechanical drive hammer capable of being applied to both fluid drilling and air drilling. Additional apparatus, systems, and methods are disclosed.

16 Claims, 6 Drawing Sheets

(56) References Cited

U.S. PATENT DOCUMENTS

| | | | | |
|---|---|---|---|---|
| 2015/0315846 | A1* | 11/2015 | Tulloch | C09J 183/04<br>175/57 |
| 2016/0130898 | A1* | 5/2016 | Solem | E21B 7/24<br>166/177.6 |
| 2016/0273294 | A1* | 9/2016 | Moyes | E21B 31/107 |

* cited by examiner

HAMMER DRILL MECHANISM

TECHNICAL FIELD

The present invention relates generally to apparatus for drilling.

BACKGROUND

In drilling wells for oil and gas exploration, the environment in which the drilling tools operate is at significant distances below the surface. Due to harsh environments and depths in which drilling in formations is conducted, enhanced efficiencies to drilling mechanisms are desirable.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, a mechanical-operated hammer unit can be structured to be run in both a hydraulic drilling operation and a pneumatic drilling operation. Pneumatic drilling can use air or other gas to drive drilling components of a tool downhole during drilling, while hydraulic drilling can use one or more liquids to drive drilling components of a tool downhole during drilling. The liquids may include what is referred to as mud, which can be taken to be drilling fluid that can used in hydrocarbon drilling and may include different types of water-based, oil-based, and synthetic-based drilling liquids. To aid in facilitation of such flexible operation, a mechanical-operated hammer unit may be combined with a positive displacement motor (PDM) providing a combo motor.

Figure 1:
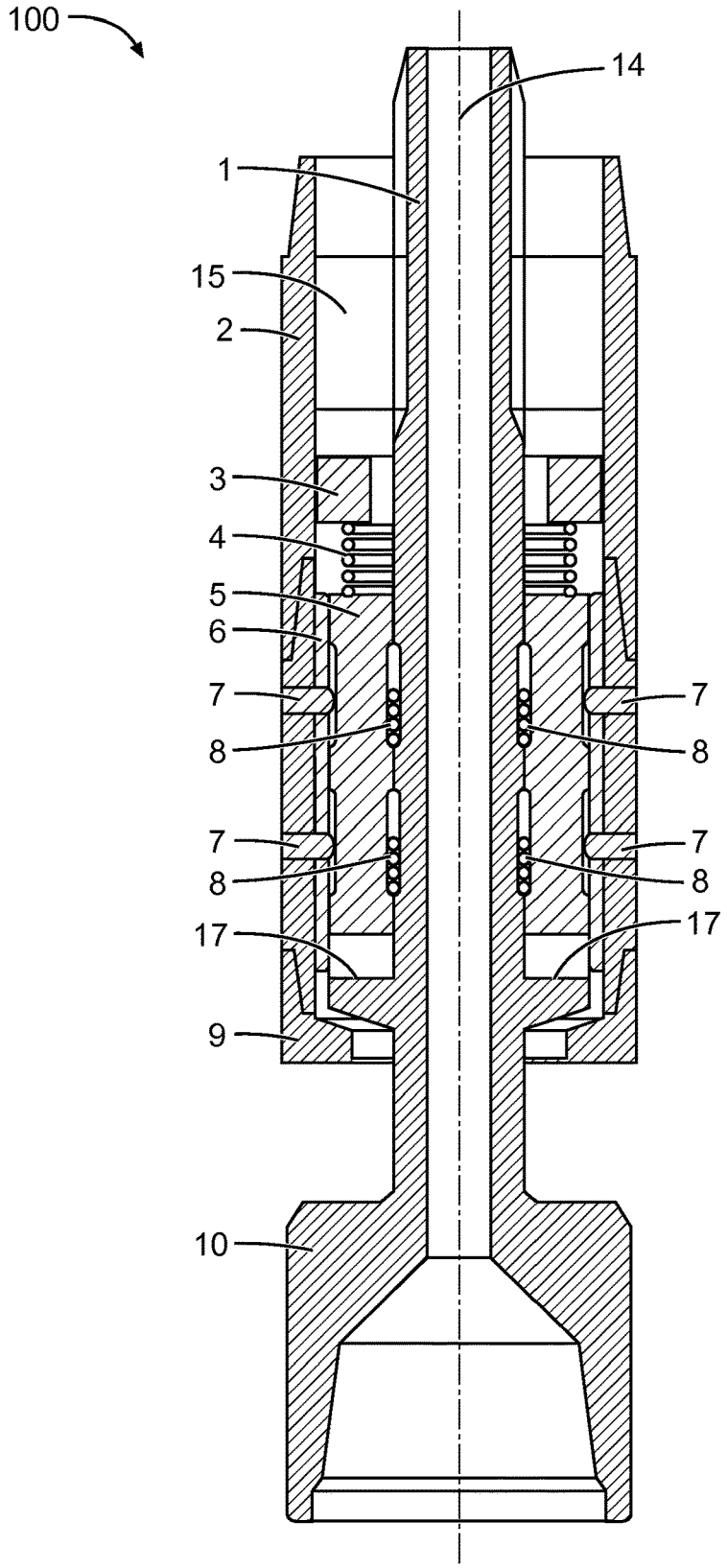
FIG. 1 is a schematic diagram of a cross-section of an example drilling apparatus that includes a mechanical-operated hammer, in accordance with various embodiments.

FIG. 1 is a schematic diagram an example embodiment of a drilling apparatus 100 that includes a mechanical-operated hammer. The drilling apparatus 100 can include a housing 2, a rotary drive shaft 1 disposed in the housing 2, and a hammer 2 within the housing 2. The rotary drive shaft 1 can be located along a longitudinal axis 14 of the housing 2, where the rotary drive shaft 1 can rotate in the housing 2, while the housing 2 remains stationary. The rotary drive shaft 1 can be realized as a rotary drive shaft with splines 13, as shown in FIG. 5, where FIG. 5 is a schematic representation of a portion of the rotary drive shaft 1 having the splines 13. The rotary drive shaft 1 can be connected to an upper drive shaft in a drill string. Splines are projections on a shaft that fit into slots on a corresponding shaft, enabling both to rotate together. A key 8 can be disposed between the hammer 5 and the rotary drive shaft 1. The key 8 can be arranged as engagement key to engage the hammer 5 with the rotary drive shaft 1 to operatively provide rotation to the hammer 5. The key 8 can be realized as a linear bearing, which only moves parallel to the axis 14. A number of keys can be used. For example, four keys can be used as shown in FIG. 1. A spring 4 can be disposed in the housing 2 and can be located between the hammer 5 and a spring retainer 3. The spring retainer 3 is fixed in the housing 2, where the housing 2 is operationally stationary to the well bore. The spring 4 can be arranged to transfer impact force, via the hammer 5, to a bit box 10 for a drill bit. The bit box 10 may be disposed with respect to a bit retainer 9.

Drilling apparatus 100 can include a guide pin 7 in the housing 2 arranged in a guide groove 11 in the hammer 5 to provide a spring load from the spring 4 to the hammer 5 correlated to position of the guide pin 7 in the guide groove 11. As shown, the drilling apparatus 100 can include a number of guide pins 7. The number of guide pins 7 may equal the number of keys 8, however, the number of guide pins 7 need not equal the number of keys 8. A number of key slots 12, shown in FIG. 2B, can be arranged between the hammer 5 and the rotary drive shaft 1 to accept the key 8. A bearing 6 is fixed to the housing 2 and can be disposed between the housing 2 and the hammer 5. The bearing 6 may extend a length along the longitudinal axis 14 such that axial motion of the hammer 5 is within the length to which the bearing 6 extends.

Figure 5A:
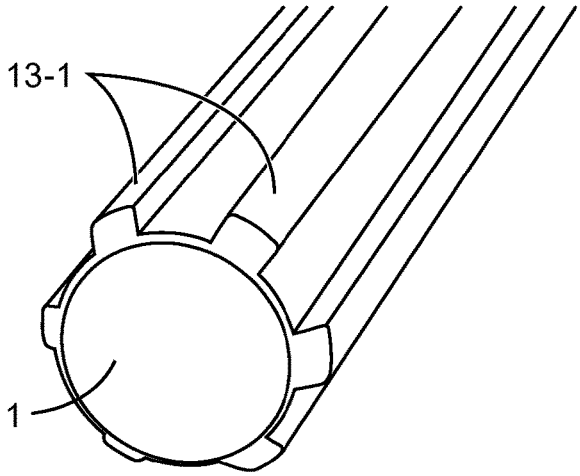
FIG. 5A is a schematic representation of a portion of an example rotary drive shaft having male splines, in accordance with various embodiments.
Figure 5B:
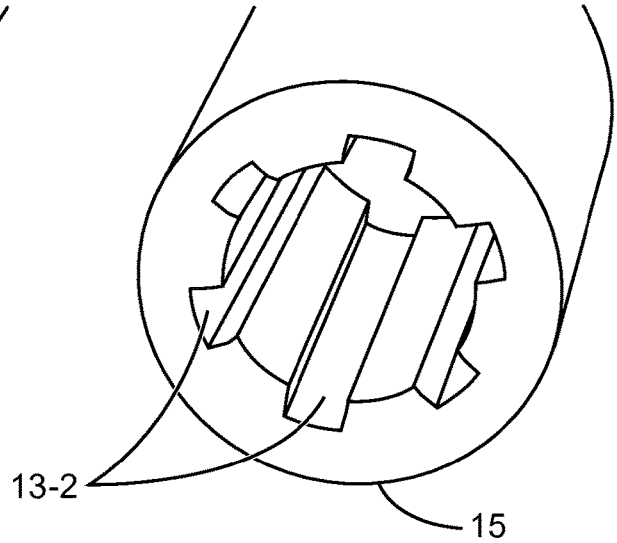
FIG. 5B is a schematic representation of a portion of example female splines of a positive displacement motor to couple the male splines on rotary drive shaft of FIG. 5A, in accordance with various embodiments.

The housing 2 may include a PDM 15 coupled to the rotary drive shaft 1 via the splines 13-1 of the rotary drive shaft 1 shown in FIGS. 5A and 5B. The splines 13-1 can be connected to the rotor of the PDM 15 such that the rotor of the PDM 15 can turn the rotary drive shaft 1. PDM 15 can include female splines 13-2 to couple the male splines 13-1 on rotary drive shaft 1 as shown in FIGS. 5B and 5A, respectively. The PDM 15 can be arranged to drive to the rotary drive shaft 1 hydraulically or pneumatically with the hammer 5 operatively driven mechanically by the spring 4. The rotary drive shaft 1 can be coupled to a drill string. The housing 2 can be disposed in a directional drilling tool. The housing 2 can be disposed in a mud motor.

Figure 2A:
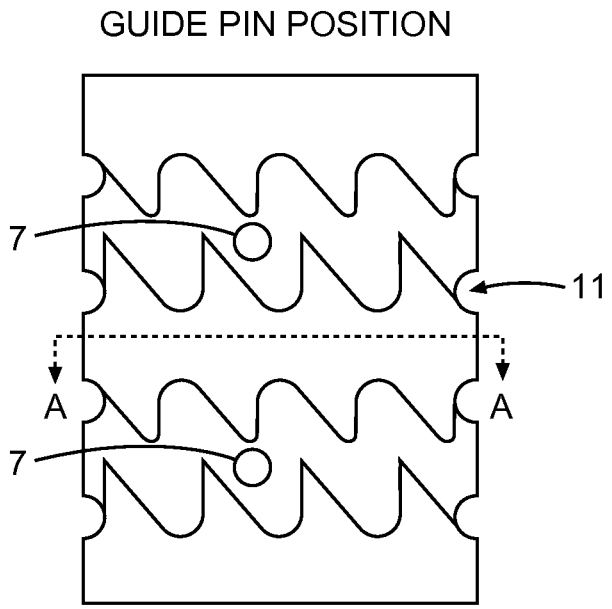
FIG. 2A is a schematic diagram of a guide pin in a guide groove, in accordance with various embodiments.
Figure 2B:
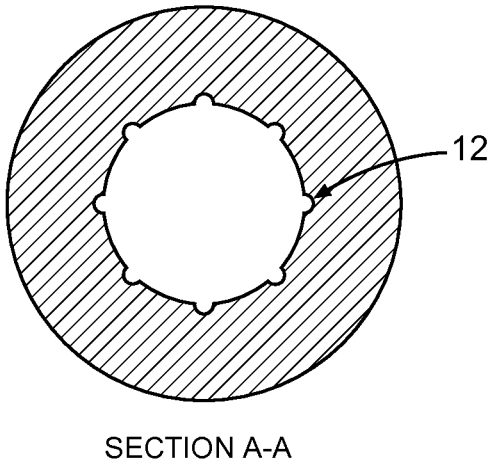
FIG. 2B is a schematic representation of key slots to which the rotary drive shaft of FIG. 1 can engage, in accordance with various embodiments.

FIG. 1 shows rotary drive shaft 1 at a rotation position during drilling. As rotary drive shaft 1 rotates clockwise, key 8 between the hammer 5 and the drive shaft 1 acts as an engagement key, enabling hammer 5 to rotate. Rotation can be from a mud motor, pneumatic motor, or other appropriate motor. FIG. 2A is a schematic diagram showing guide pin 7 in guide groove 11. The guide pin 7 is shown as a circle corresponding to the tip of guide pin 7 in FIG. 1. Rotation of the drive shaft 1 is transferred to the hammer 5 by keys 8, which are located at key slots 12. Guide groove 11 on the hammer 5 contacts the guide pins 7 due to the rotation of the hammer 5. As the hammer 5 rotates, based on the engagement with the drive shaft 1, the hammer 5 moves upward because the guide pins 7 contact the lowest end of the hammer path in guide groove 11. (See FIG. 2A.) The spring 4 is compressed when the hammer 5 move upward. The compressed spring 4 can apply its spring load to the hammer 5, by action of the spring 4 moving to its uncompressed state.

Figure 3:
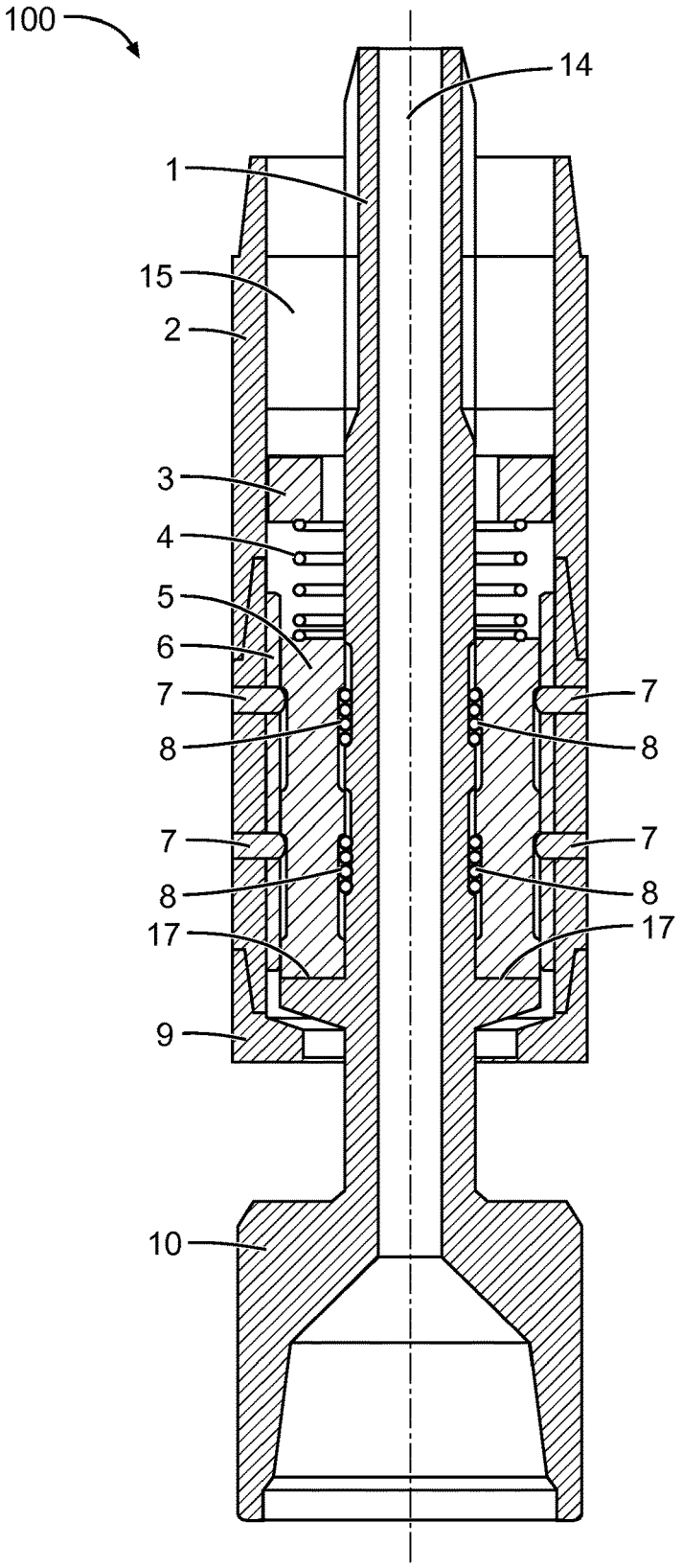
FIG. 3 is a schematic diagram of the cross-section of the example drilling apparatus of FIG. 1 in which a hammer imparts an impact force to a bit box, in accordance with various embodiments.
Figure 4:
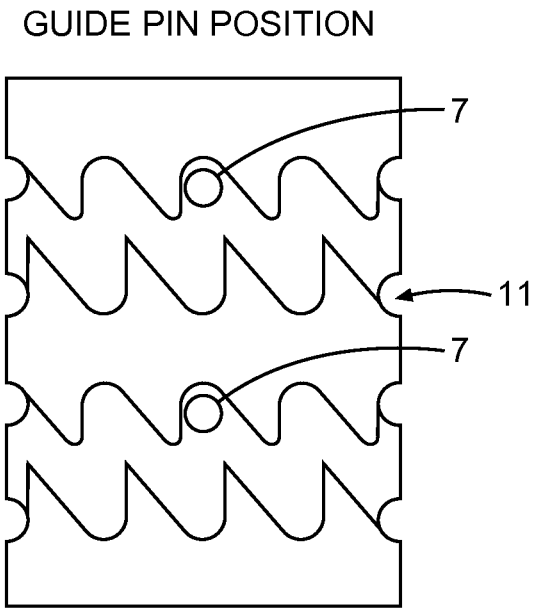
FIG. 4 is a schematic diagram of an example guide pin rotated to the lower tip of in a guide groove, in accordance with various embodiments.

Because of the spring load and continuous rotation of the rotary drive shaft 1, guide pins 7 "drop" when it passed the lowest end of the hammer path in guide groove 11. (See FIG. 4.) The hammer 5 falls, where the hammer 5 has moved based on the spring 4 reacting to the compression of the spring 4 by the hammer 5. This position is shown in FIG. 3, where FIG. 3 shows hammer 5 in contact with a shoulder 17 of the rotary drive shaft 1 connected to the bit box 10, where the hammer 5 hits the shoulder 17 of the rotary drive shaft 1 and creates an impact. At this point, hammer 5 transfers an impact force to the bit box 10. As the rotary drive shaft 1 with splines 13 rotates, the hammer 5 slides downward and transfers the impact force to the drill bit via the bit box 10. The splines 13-1 from the rotary drive shaft 1 of FIG. 5A slide a very short distance from female splines 13-1 of FIG. 5B, where there is rotation transfer. During drilling, rotary drive shaft 1 can continually rotate, repeating the above-mentioned actions of the hammer 5 moving up to compress the spring 4 and sliding down to transfer force from the spring 4 to the bit box 10. As a result, impact is continually applied to the drill bit as a periodic impact corresponding to the motion of the hammer 5 as it rotates upward and slides downward, tied to the engagement with the rotary drive shaft 1.

Figure 6:
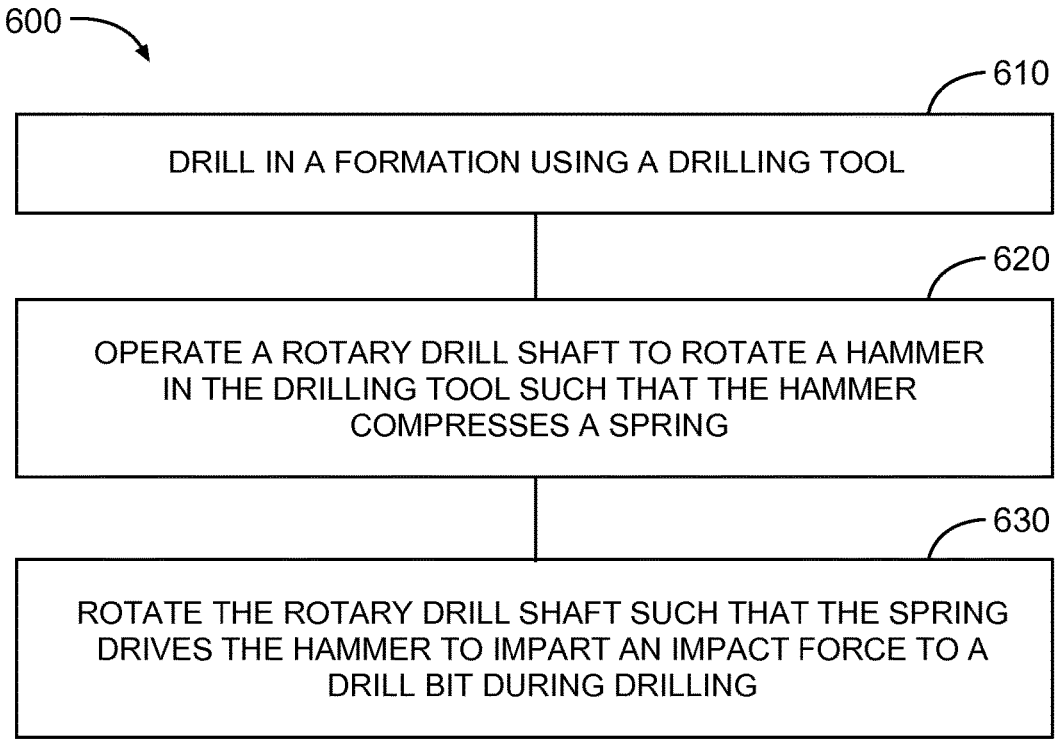
FIG. 6 is a flow diagram of an example method of operating a hammer drill mechanism, in accordance with various embodiments.

FIG. 6 is a flow diagram of an embodiment of a method 600 of operating a hammer drill mechanism. At 610, a drilling tool is used to drill in a formation. At 620, a rotary drill shaft is operated to rotate a hammer in the drilling tool such that the hammer compresses a spring. Operating the rotary drill shaft can include driving the rotary drill shaft using a positive displacement motor disposed in housing with the hammer and the spring. Operating the rotary drill shaft may include driving the rotary drill shaft using a motor operating hydraulically. The motor may be a positive displacement motor disposed in housing with the hammer and the spring. Alternatively, operating the rotary drill shaft may include driving the rotary drill shaft using a motor operating pneumatically. The motor may be a positive displacement motor disposed in housing with the hammer and the spring. At 630, the rotary drill shaft is rotated such that the spring drives the hammer to impart an impact force to a drill bit during the drilling.

The method 600 or a similar method to drill in the formation can include rotating the drill bit in contact with the formation. The method 600 or a similar method to drill in the formation can include directional drilling. The method 600 or a similar method to drill in the formation can include operating the drilling tool as a measurement-while-drilling tool.

Figure 7:
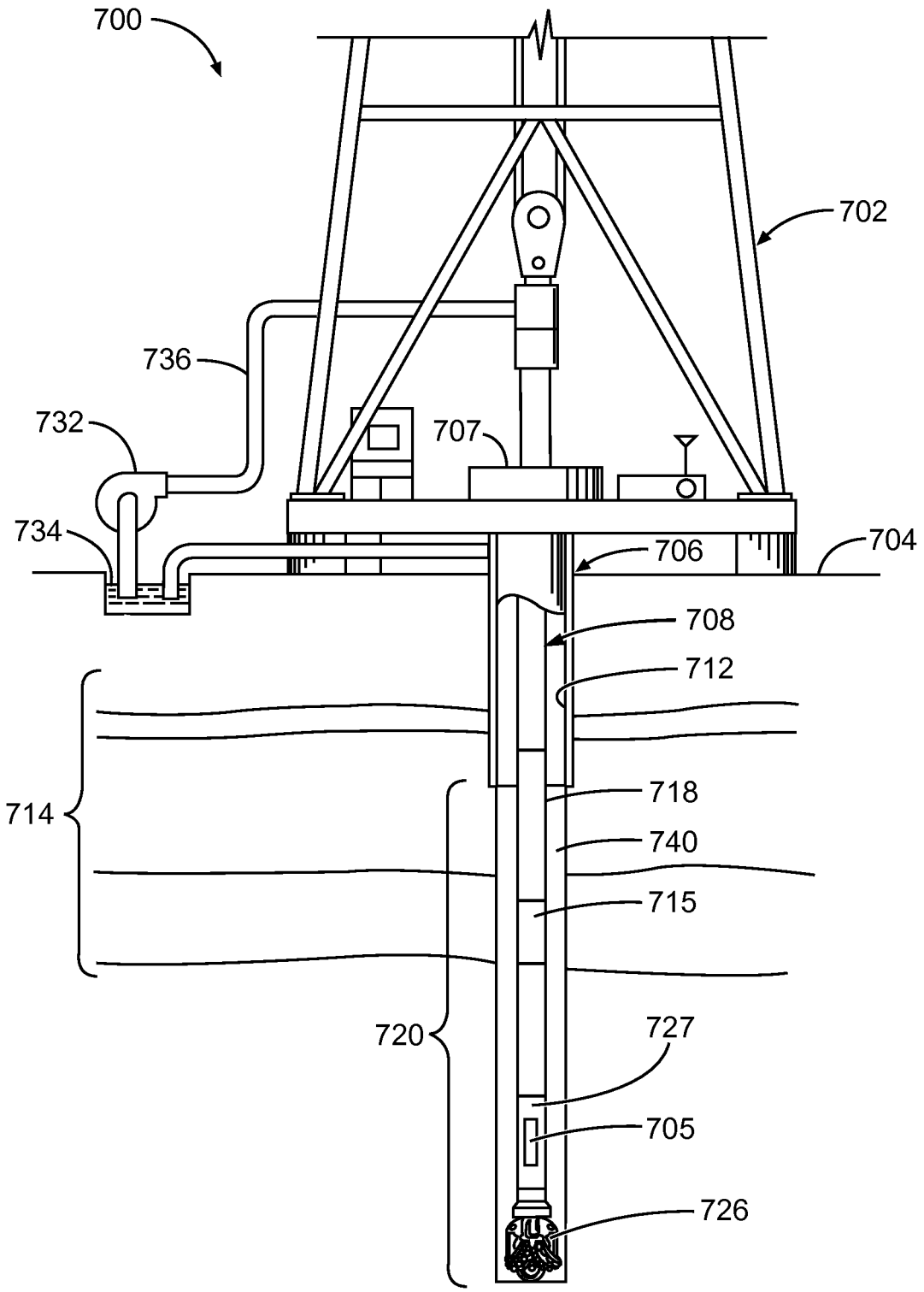
FIG. 7 is a schematic representation of an example system at a drilling site, where the system includes a drilling apparatus having a mechanical-operated hammer, in accordance with various embodiments.

FIG. 7 depicts an example embodiment of a system 700 at a drilling site, where the system 700 includes a drilling apparatus 705 having a mechanical-operated hammer. The drilling apparatus 705 having a mechanical-operated hammer can be realized in a similar or identical manner to a drilling apparatus having a mechanical-operated hammer discussed herein and can be configured to operate in accordance with the teachings herein. The system 700 can be arranged in a land based drilling operation or a subsea drilling operation.

The system 700 can include a drilling rig 702 located at a surface 704 of a well 706 and a string of drill pipes, that is, the drill string 708, connected together so as to form a drilling string that is lowered through a rotary table 707 into a wellbore or borehole 712. The drilling rig 702 can provide support for the drill string 708. The drill string 708 can operate to penetrate rotary table 707 for drilling a borehole 712 through subsurface formations 714. The drill string 708 can include drill pipe 718 and a bottom hole assembly 720 located at the lower portion of the drill string 708.

The bottom hole assembly 720 can include drill collar 715 and a drill bit 726. The drill bit 726 can operate to create the borehole 712 by penetrating the surface 704 and the subsurface formations 714. The drilling apparatus 705 having a mechanical-operated hammer can be structured for an implementation in the borehole 712 of a well as a measurements-while-drilling (MWD) system such as a logging-while-drilling (LWD) system to determine formation properties, which can be used to direct drilling operations based on the determined properties.

During drilling operations, the drill string 708 can be rotated by the rotary table 707. In addition to, or alternatively, the bottom hole assembly 720 can also be rotated by a motor (e.g., a mud motor) that is located downhole. The drill collars 715 can be used to add weight to the drill bit 726. The drill collars 715 also can stiffen the bottom hole assembly 720 to allow the bottom hole assembly 720 to transfer the added weight to the drill bit 726, and in turn, assist the drill bit 726 in penetrating the surface 704 and subsurface formations 714.

During drilling operations, a mud pump 732 can pump drilling fluid, which can be drilling mud, from a mud pit 734 through a hose 736 into the drill pipe 718 and down to the drill bit 726. A mud motor 727 can be disposed above drill bit 726 to create rotation for the drill bit. The drilling fluid can flow out from the drill bit 726 and be returned to the surface 704 through an annular area 740 between the drill pipe 718 and the sides of the borehole 712. The drilling fluid may then be returned to the mud pit 734, where such fluid is filtered. In some embodiments, the drilling fluid can be used to cool the drill bit 726, as well as to provide lubrication for the drill bit 726 during drilling operations. Additionally, the drilling fluid may be used to remove the subsurface formation 714 cuttings created by operating the drill bit 726.

In an example 1, a drilling apparatus can comprise: a housing; a rotary drive shaft disposed in the housing, the rotary drive shaft located along a longitudinal axis of the housing; a hammer within the housing; a key disposed between the hammer and the rotary drive shaft, the key arranged as engagement key to engage the hammer with the rotary drive shaft to operatively provide rotation to the hammer; and a spring disposed in the housing and located between the hammer and a spring retainer, the spring arranged to transfer impact force, via the hammer, to a bit box. The rotary drive shaft can be from a mud motor.

In an example 2, the subject matter of example 1 can include a guide pin in the housing arranged in a guide groove to provide a spring load from the spring to the hammer correlated to position of the guide pin in the guide groove.

In an example 3, the subject matter of example 1 or 2 can include a number of key slots arranged between the hammer and the rotary drive shaft to accept the key.

In an example 4, the subject matter of any of examples 1-3 can include a bearing disposed between the housing and the hammer.

In an example 5, the subject matter of any of examples 1-4 can include a bearing extending a length along the longitudinal axis such that motion of the hammer is within the length to which the bearing extends.

In an example 6, the subject matter of any of examples 1-5 can include the housing to include a positive displacement motor coupled to the rotary drive shaft via splines of the rotary drive shaft.

In an example 7, the subject matter of any of examples 1-6 can include the positive displacement motor arranged to drive to the rotary drive shaft hydraulically or pneumatically with the hammer operatively driven mechanically by the spring.

In an example 8, the subject matter of any of examples 1-7 can include the rotary drive shaft coupled to a drill string.

In an example 9, the subject matter of any of examples 1-8 can include the housing disposed in a directional drilling tool.

In an example 10, the subject matter of any of examples 1-9 can include the housing is disposed in a measurement-while-drilling tool.

Hammer drill mechanisms similar to or identical to hammer drill mechanisms taught herein can provide operational flexibility. Though conventional hammer drills are typically capable to be driven by liquid or air but not both, embodiments of hammer drill mechanisms that are mechanical drive hammers, as taught herein, may apply to both fluid drilling and air drilling. It is noted that, since conventional mechanical hammer drills attach as additional components at the bit box end, such conventional mechanical hammer drills effectively increase the length of the drill bit. Embodiments of hammer drill mechanisms that can be applied to both air and fluid drilling applications can be installed integrated with PDM motors whose housing stay stationary during drilling. With such hammer drill mechanisms integrated with the PDM motor, the effective drill bit length effectively stays the same as a configuration without a hammer drill.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A drilling apparatus comprising:

a housing;

a rotary drive shaft disposed in the housing and configured to rotate with respect to the housing while drilling, the rotary drive shaft located along a longitudinal axis of the housing;

a hammer within the housing and surrounding the rotary drive shaft, the hammer defining a guide groove on an outer surface;

a key disposed between the hammer and the rotary drive shaft, the key arranged as an engagement key to engage the hammer with the rotary drive shaft to continuously rotate the hammer at the same rotational speed as the rotary drive shaft while allowing the hammer to move axially with respect to the rotary drive shaft;

a bit box coupled to a portion of the rotary driveshaft extending through the hammer;

a spring disposed in the housing and located between the hammer and a spring retainer;

a guide pin extending from the housing into the guide groove; and wherein the guide groove is positioned to engage the guide pin to move the hammer axially to alternately compress the spring and allow the spring to drive the hammer to impact the rotary drive shaft to impart an impact force to the bit box as the hammer rotates.

2. The drilling apparatus of claim 1, wherein a number of key slots are arranged between the hammer and the rotary drive shaft to accept the key.

3. The drilling apparatus of claim 1, wherein a bearing is disposed between the housing and the hammer.

4. The drilling apparatus of claim 3, wherein the bearing extends a length along the longitudinal axis such that motion of the hammer is within the length to which the bearing extends.

5. The drilling apparatus of claim 1, wherein the housing includes a positive displacement motor coupled to the rotary drive shaft via splines of the rotary drive shaft.

6. The drilling apparatus of claim 5, wherein the positive displacement motor is arranged to drive to the rotary drive shaft hydraulically or pneumatically with the hammer operatively driven mechanically by the spring.

7. The drilling apparatus of claim 1, wherein the rotary drive shaft is coupled to a drill string.

8. The drilling apparatus of claim 1, wherein the housing is disposed in a directional drilling tool.

9. The drilling apparatus of claim 1, wherein the housing is disposed in a measurement-while-drilling tool.

10. A method comprising:

drilling in a formation using a drilling tool;

operating a rotary drill shaft extending through a hammer to rotate the rotary drill shaft and the hammer with respect to a housing of the drilling tool such that a guide groove formed on an outer surface of the hammer interfaces with a guide pin extending from the housing and compresses a spring; and rotating the rotary drill shaft to continuously rotate the hammer at the same speed as the rotary drill shaft such that the guide groove allows the spring to decompress and drive the hammer to impact the rotary drill shaft to impart an impact force to a drill bit during the drilling.

11. The method of claim 10, wherein operating the rotary drill shaft includes driving the rotary drill shaft using a positive displacement motor disposed in the housing with the hammer and the spring.

12. The method of claim 10, wherein operating the rotary drill shaft includes driving the rotary drill shaft using a motor operating hydraulically.

13. The method of claim 10, wherein operating the rotary drill shaft includes driving the rotary drill shaft using a motor operating pneumatically.

14. The method of claim 10, wherein drilling in the formation includes rotating the drill bit in contact with the formation.

15. The method of claim 10, wherein drilling in the formation includes directional drilling.

16. The method of claim 10, wherein drilling in the formation includes operating the drilling tool as a measurement-while-drilling tool.

* * * * *